US012648650B2

(12) United States Patent
Johnson et al.

(10) Patent No.: US 12,648,650 B2
(45) Date of Patent: Jun. 9, 2026

(54) THEATER CHAIR OR SEAT WITH A FLIP-UP/FLIP-DOWN SEAT MEMBER, A RECLINING BACK MEMBER, AND AN AUTOMATIC RETURN

(71) Applicant: HIDDENLAKE 822, LLC, Tupelo, MS (US)

(72) Inventors: Terry Dale Johnson, Baldwyn, MS (US); Stephen R. Lake, Tupelo, MS (US)

(73) Assignee: HIDDENLAKE 822 LLC, Tupelo, MS (US)

( * ) Notice: Subject to any disclaimer, the term of this patent is extended or adjusted under 35 U.S.C. 154(b) by 189 days.

(21) Appl. No.: 18/612,643

(22) Filed: Mar. 21, 2024

(65) Prior Publication Data

US 2025/0295236 A1 Sep. 25, 2025

(51) Int. Cl.

| | |
|---|---|
| ***A47C 1/12*** | (2006.01) |
| ***A47C 1/121*** | (2006.01) |
| ***A47C 7/56*** | (2006.01) |
| *A47C 1/032* | (2006.01) |

(52) U.S. Cl.

CPC ..... *A47C 7/563* (2013.01); *A47C 1/121* (2013.01); *A47C 1/03211* (2013.01); *A47C 1/03216* (2013.01); *A47C 1/03272* (2013.01); *A47C 1/03274* (2018.08)

(58) Field of Classification Search

CPC ..... A47C 1/121; A47C 7/563

See application file for complete search history.

(56) References Cited

U.S. PATENT DOCUMENTS

| | | | | |
|---|---|---|---|---|
| 9,993,080 | B2 * | 6/2018 | Jacobs | A47C 1/0242 |
| 10,188,213 | B2 * | 1/2019 | Johnson | A47C 1/121 |
| 10,568,429 | B2 * | 2/2020 | Jacobs | F16B 12/00 |
| 10,722,032 | B2 * | 7/2020 | Jacobs | A47C 7/622 |
| 11,793,311 | B2 * | 10/2023 | Johnson | A47C 1/121 |

* cited by examiner

*Primary Examiner* — Rodney B White

(74) *Attorney, Agent, or Firm* — Law Offices of Steven W. Weinrieb

(57) ABSTRACT

A theater chair comprises a flip-up/flip-down seat, a reclining backrest, and a reclining seat. An actuator is operatively connected to the reclining backrest for moving the backrest and seat from a normal or default upright position to any one of a multitude of reclined positions. The flip-up/flip-down seat is provided with a spring for returning the seat to its upright position when the seat is unoccupied. A sensor is operatively associated with the seat so as to effectively monitor the orientation of the seat. When the seat is vacated, the sensor will detect movement of the seat and send an appropriate signal to a control circuit which is operatively connected to the actuator. After a predetermined period of time, the actuator will be actuated so as to return the backrest from the reclined position to the default upright position.

14 Claims, 8 Drawing Sheets

THEATER CHAIR OR SEAT WITH A FLIP-UP/FLIP-DOWN SEAT MEMBER, A RECLINING BACK MEMBER, AND AN AUTOMATIC RETURN

FIELD OF THE INVENTION

The present invention relates to furniture seating, more particularly to theater seating, and still more particularly, to a theater chair or seat with a flip-up/flip-down seat member and a reclined backrest member, wherein the seat member and the backrest member are mounted upon a seat/backrest framework, and wherein there is provided an automatic return operatively associated with the seat/backrest framework so as to return the reclined seat/backrest framework to the normal, default, upright position once the occupant has vacated the seat. While the disclosure is oriented toward a theater chair or seat, the principles and teachings of the present invention may likewise be applied to a bus seat, a train seat, an airplane seat, and the like.

BACKGROUND OF THE INVENTION

In connection with today's theater seating, particularly in connection with current stadium-type seating, wherein it is endeavored to provide patrons with luxury seating units in order to, in turn, provide the patrons with the highest degree of comfort, such stadium seats usually comprise a flip-up/flip-down seat, and a backrest which reclines, so as to in fact provide an enhanced degree of comfort to the patron. It is well known, however, that one drawback of such luxury seating, comprising a flip-up/flip-down seat and a backrest which reclines, is that such seating can usually encompass a relatively large footprint which adversely affects the number of seating units that can be incorporated within a theater space having predeterminedly sized dimensions.

A need therefore exists in the art for a new and improved theater chair. Another need exists in the art for a new and improved theater chair which is especially developed for use in connection with conventional stadium-type theater seating. Still another need exists in the art for a new and improved theater chair which is especially developed for use in connection with conventional stadium-type theater seating wherein the theater chair comprises a flip-up/flip-down theater chair. Yet another need exists in the art for a new and improved theater chair which is especially developed for use in connection with conventional stadium-type theater seating wherein the theater chair comprises a flip-up/flip-down theater chair, and wherein the chair also comprises a reclining backrest. Still yet another need exists in the art for a new and improved theater chair which is especially developed for use in connection with conventional stadium-type theater seating wherein the theater chair comprises a flip-up/flip-down theater chair, and wherein the chair also comprises a reclining backrest having structure for automatically returning the backrest to the non-reclined position. An additional need exists in the art for a new and improved theater chair which is especially developed for use in connection with conventional stadium-type theater seating wherein the theater chair comprises a flip-up/flip-down theater chair, wherein the chair also comprises a reclining backrest having structure for automatically returning the backrest to the non-reclined position, and wherein the theater chair structure therefore has a relatively small footprint. A still additional need exists in the art for a new and improved theater chair which is especially developed for use in connection with conventional stadium-type theater seating wherein the theater chair comprises a flip-up/flip-down theater chair, wherein the chair also comprises a reclining backrest having structure for automatically returning the backrest to the non-reclined position, and wherein the theater chair structure therefore has a relatively small footprint whereby the theater seating capacity can effectively be maximized for a theater having a predetermined size.

A yet additional need exists in the art for a new and improved theater chair which is especially developed for use in connection with conventional stadium-type theater seating wherein the theater chair comprises a flip-up/flip-down theater chair, wherein the chair also comprises a reclining backrest having structure for automatically returning the backrest to the non-reclined position such that predetermined spacing between rows of seats can be maintained so as to satisfy local fire code requirements, and wherein the theater chair structure therefore has a relatively small footprint whereby the theater seating capacity can effectively be maximized for a theater having a predetermined size. A yet still additional need exists in the art for a new and improved theater chair which is especially developed for use in connection with conventional stadium-type theater seating wherein the theater chair comprises a flip-up/flip-down theater chair, wherein the chair also comprises a reclining backrest having structure for automatically returning the backrest to the non-reclined position such that predetermined spacing between rows of seats can be maintained so as to satisfy local fire code requirements, wherein the theater chair structure therefore has a relatively small footprint whereby the theater seating capacity can effectively be maximized for a theater having a predetermined size, and wherein the chair can be utilized in connection with both level or sloped floor designs. A still yet additional need exists in the art for a new and improved theater chair which is especially developed for use in connection with conventional stadium-type theater seating wherein the theater chair comprises a flip-up/flip-down theater chair, wherein the chair also comprises a reclining backrest having structure for automatically returning the backrest to the non-reclined position such that predetermined spacing between rows of seats can be maintained so as to satisfy local fire code requirements, wherein the theater chair structure therefore has a relatively small footprint whereby the theater seating capacity can effectively be maximized for a theater having a predetermined size, wherein the chair can be utilized in connection with both level or sloped floor designs, and wherein all of the aforenoted needs can be met by means of a chair that does not require complex linkage systems.

OVERALL OBJECTIVES OF THE INVENTION

Accordingly, an overall objective of the present invention is to provide a new and improved theater chair. Another need exists in the art for a new and improved theater chair which is especially developed for use in connection with conventional stadium-type theater seating. Still another overall objective of the present invention is to provide a new and improved theater chair which is especially developed for use in connection with conventional stadium-type theater seating wherein the theater chair comprises a flip-up/flip-down theater chair. Yet another overall objective of the present invention is to provide a new and improved theater chair which is especially developed for use in connection with conventional stadium-type theater seating wherein the theater chair comprises a flip-up/flip-down theater chair, and wherein the chair also comprises a reclining backrest. Still yet another overall objective of the present invention is to provide a new and improved theater chair which is especially developed for use in connection with conventional stadium-type theater seating wherein the theater chair comprises a flip-up/flip-down theater chair, and wherein the chair also comprises a reclining backrest having structure for automatically returning the backrest to the non-reclined position.

An additional overall objective of the present invention is to provide a new and improved theater chair which is especially developed for use in connection with conventional stadium-type theater seating wherein the theater chair comprises a flip-up/flip-down theater chair, wherein the chair also comprises a reclining backrest having structure for automatically returning the backrest to the non-reclined position, and wherein the theater chair structure effectively provides the theater chair with a relatively small footprint. A still additional overall objective of the present invention is to provide a new and improved theater chair which is especially developed for use in connection with conventional stadium-type theater seating wherein the theater chair comprises a flip-up/flip-down theater chair, wherein the chair also comprises a reclining backrest having structure for automatically returning the backrest to the non-reclined position, and wherein the theater chair structure effectively provides the theater chair with a relatively small footprint whereby the theater seating capacity can effectively be maximized for a theater having a predetermined size.

A yet additional overall objective of the present invention is to provide a new and improved theater chair which is especially developed for use in connection with conventional stadium-type theater seating wherein the theater chair comprises a flip-up/flip-down theater chair, wherein the chair also comprises a reclining backrest having structure for automatically returning the backrest to the non-reclined position such that predetermined spacing between rows of seats can be maintained so as to satisfy local fire code requirements, and wherein the theater chair structure therefore has a relatively small footprint whereby the theater seating capacity can effectively be maximized for a theater having a predetermined size. A yet still additional overall objective of the present invention is to provide a new and improved theater chair which is especially developed for use in connection with conventional stadium-type theater seating wherein the theater chair comprises a flip-up/flip-down theater chair, wherein the chair also comprises a reclining backrest having structure for automatically returning the backrest to the non-reclined position such that predetermined spacing between rows of seats can be maintained so as to satisfy local fire code requirements, wherein the theater chair structure therefore has a relatively small footprint whereby the theater seating capacity can effectively be maximized for a theater having a predetermined size, and wherein the chair can be utilized in connection with both level or sloped floor designs. A still yet additional overall objective of the present invention is to provide a new and improved theater chair which is especially developed for use in connection with conventional stadium-type theater seating wherein the theater chair comprises a flip-up/flip-down theater chair, wherein the chair also comprises a reclining backrest having structure for automatically returning the backrest to the non-reclined position such that predetermined spacing between rows of seats can be maintained so as to satisfy local fire code requirements, wherein the theater chair structure therefore has a relatively small footprint whereby the theater seating capacity can effectively be maximized for a theater having a predetermined size, wherein the chair can be utilized in connection with both level or sloped floor designs, and wherein all of the aforenoted needs can be met by means of a chair that does not require complex linkage systems.

SUMMARY OF THE INVENTION

In accordance with the principles and teachings of the present invention, a new and improved theater chair has been developed wherein the theater chair comprises a flip-up/flip-down seat, and a reclining backrest. The seat and backrest are mounted upon a seat/backrest framework, and a linear actuator is operatively connected to the seat/backrest framework for effectively moving the seat/backrest framework from a normal or default upright position to any one of a multitude of reclined positions, as well as to recline the seat backwardly whereby the rear portion of the seat will be disposed at an elevation which is lower than that of the front portion of the seat. The flip-up/flip-down seat is conventionally provided with a spring or other similar mechanism for automatically returning the seat to its upright position when the seat becomes unoccupied as a result of the theater patron exiting or leaving the seat. In addition, a suitable proximity sensor, such as, for example, a Hall sensor, is operatively associated with the seat so as to effectively monitor the disposition or orientation of the seat. Accordingly, when the seat is returned from its lowered or deployed seat-down position to its upright or stowed seat-up position as a result of the theater patron exiting or leaving the seat, the sensor will detect such movement and disposition and will send an appropriate signal to a timing control circuit which is operatively connected to the linear actuator. After a predetermined period of time, as determined by means of the timing control circuit, the linear actuator will be actuated so as to return the seat/backrest framework from the reclined position to the normal or default upright position. Oppositely disposed side portions of the seat/backrest framework have oppositely disposed pins or rods disposed within forward, substantially horizontally oriented slots, and rearward, inclined slots, provided within oppositely disposed side arms of the chair framework such that as the seat/backrest framework is moved between the upright and reclined positions, the seat/backrest framework will undergo a movement which is characterized by means of an arcuate locus.

BRIEF DESCRIPTIONS OF THE DRAWINGS

Various other features and attendant advantages of the present invention will be more fully appreciated from the following detailed description when considered in connection with the accompanying drawings in which like reference characters designate like or corresponding parts throughout the several views, and wherein.

Figure 2:
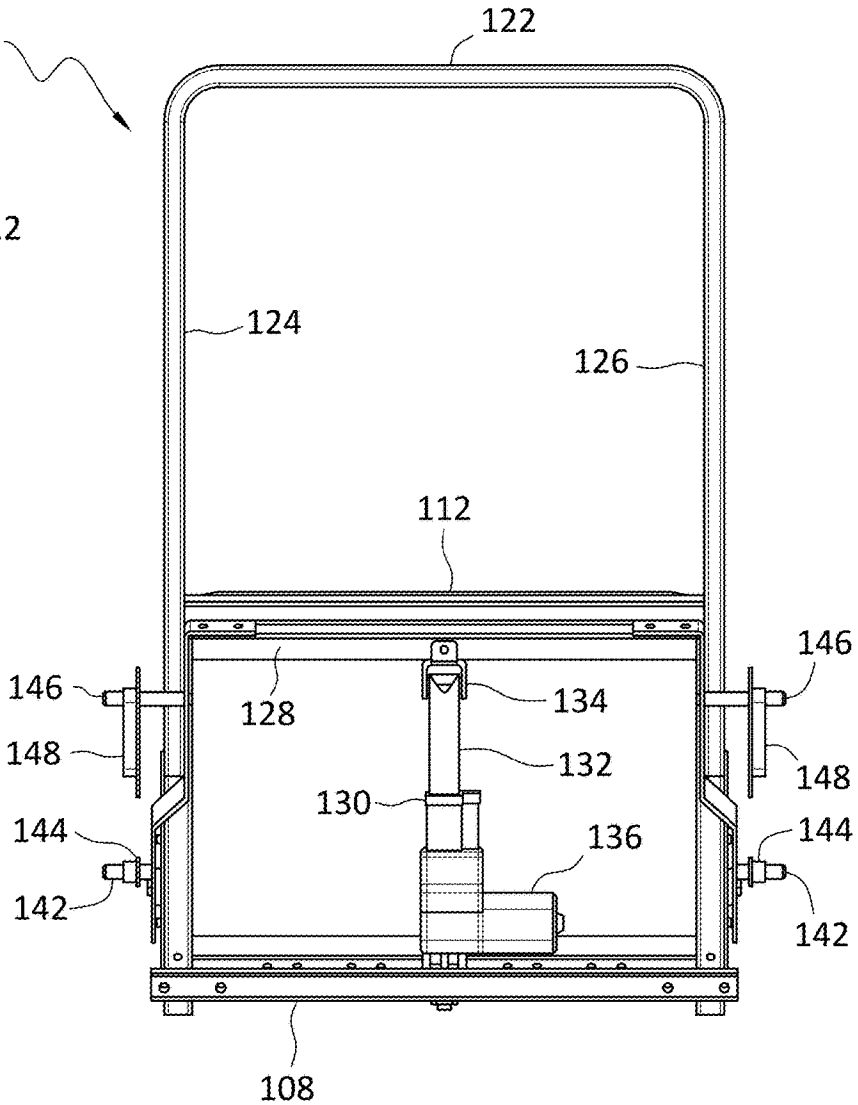
FIG. 2 is a front elevational view of the new and improved theater chair as disclosed within FIG. 1, showing the seat and backrest framework, but with the oppositely disposed sides of the chair frame being omitted for clarity.
Figure 1:
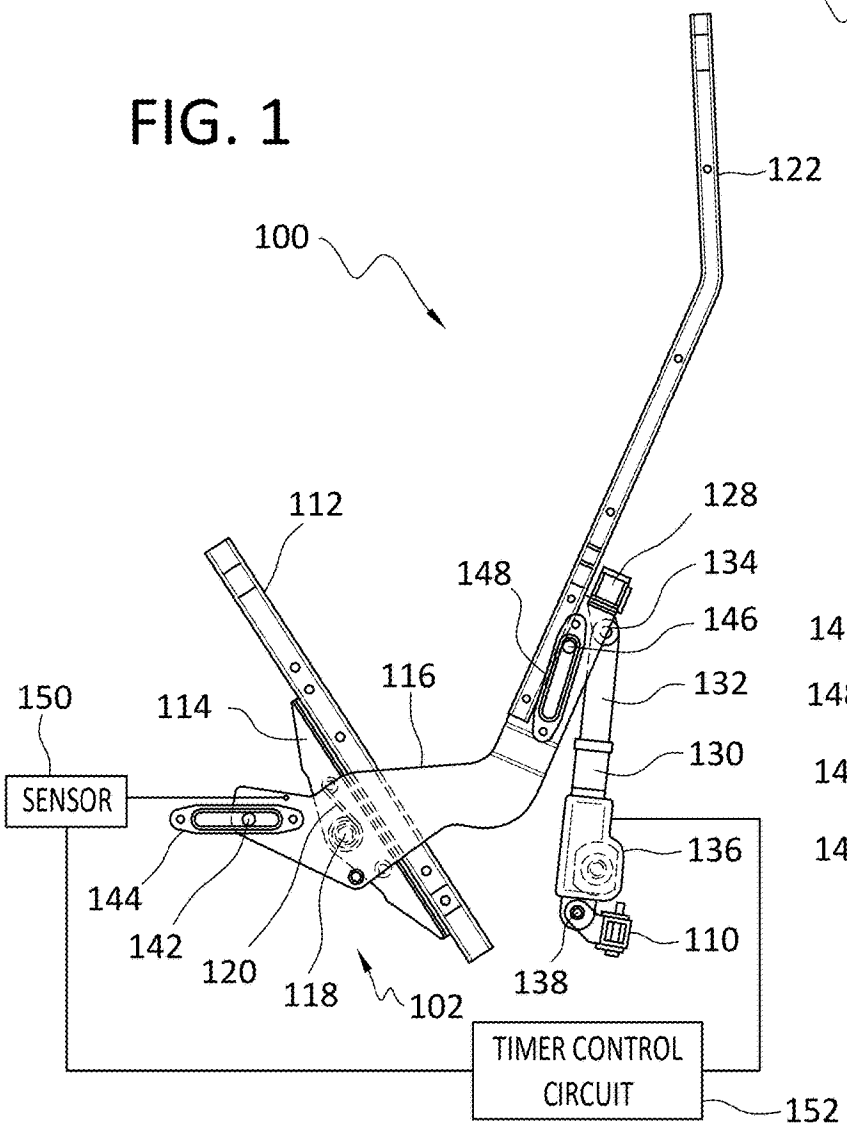
FIG. 1 is a side elevational view of the new and improved theater chair, as constructed in accordance with the principles and teachings of the present invention, and showing the chair when the seat is disposed at its default, flip-up position, and the backrest is disposed at its default upright position.
Figure 4:
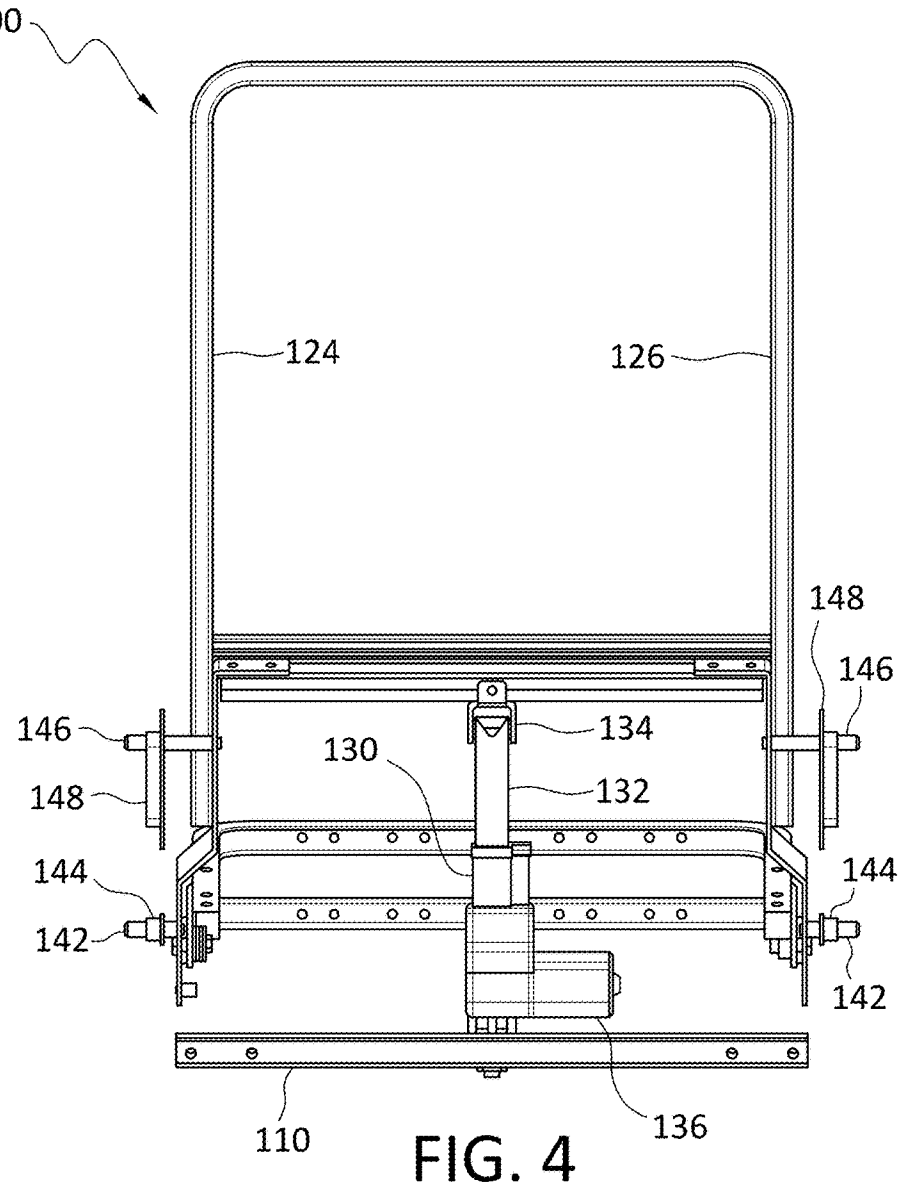
FIG. 4 is a front elevational view of the new and improved theater chair as disclosed within FIG. 3, showing the seat and backrest framework, but with the oppositely disposed sides of the chair frame being omitted for clarity.
Figure 3:
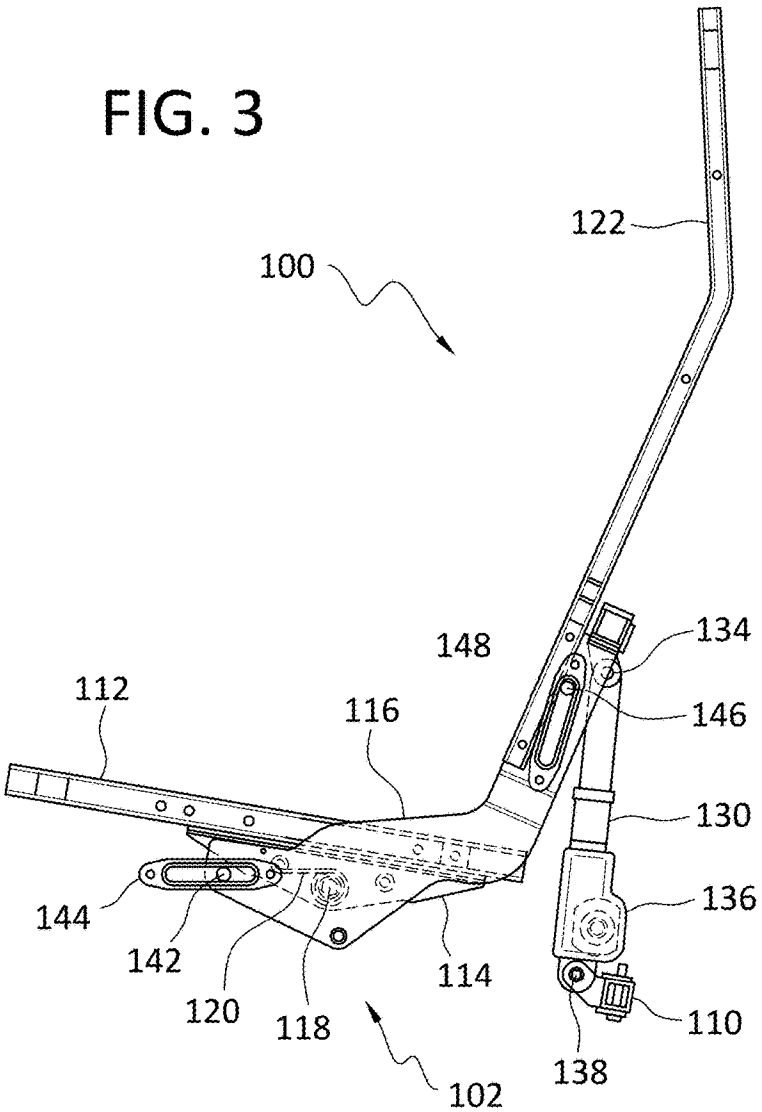
FIG. 3 is a side elevational view of the new and improved theater chair, as disclosed within FIG. 1, showing, however, the chair when the seat is disposed at its flip-down position while the backrest is disposed at its default upright position.
Figures 5, 6:
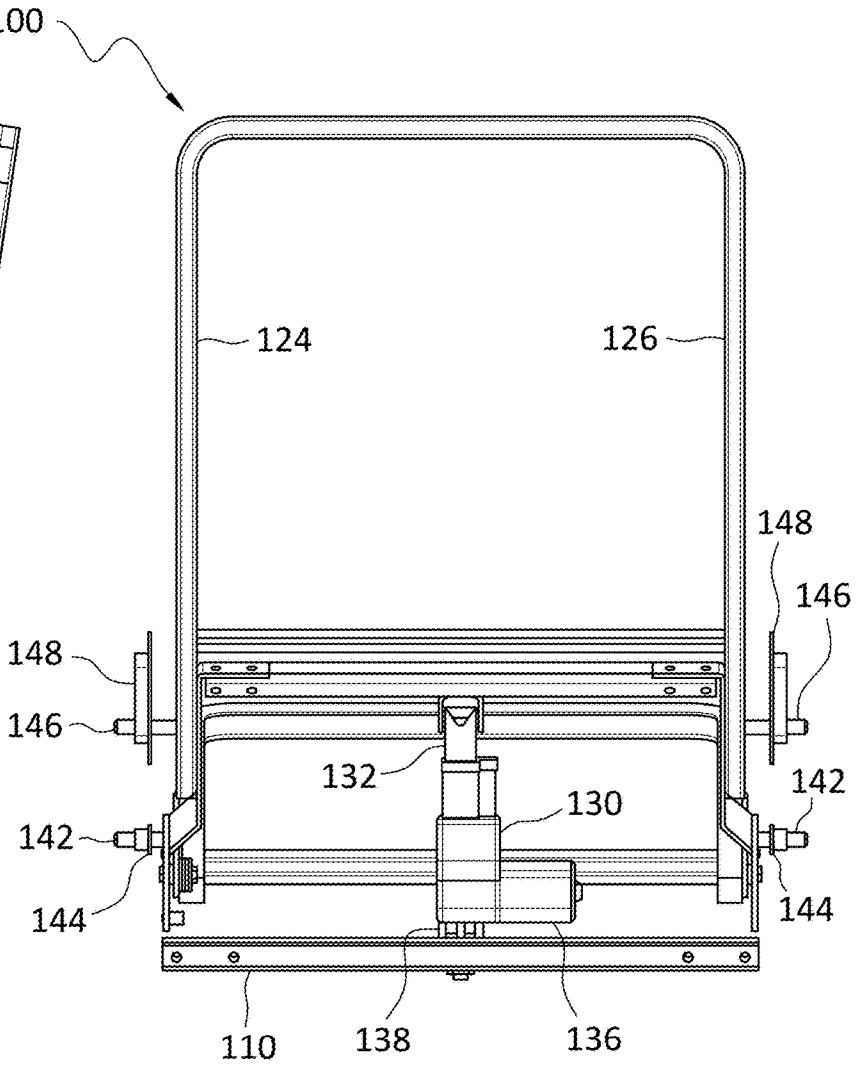
Figure 8:
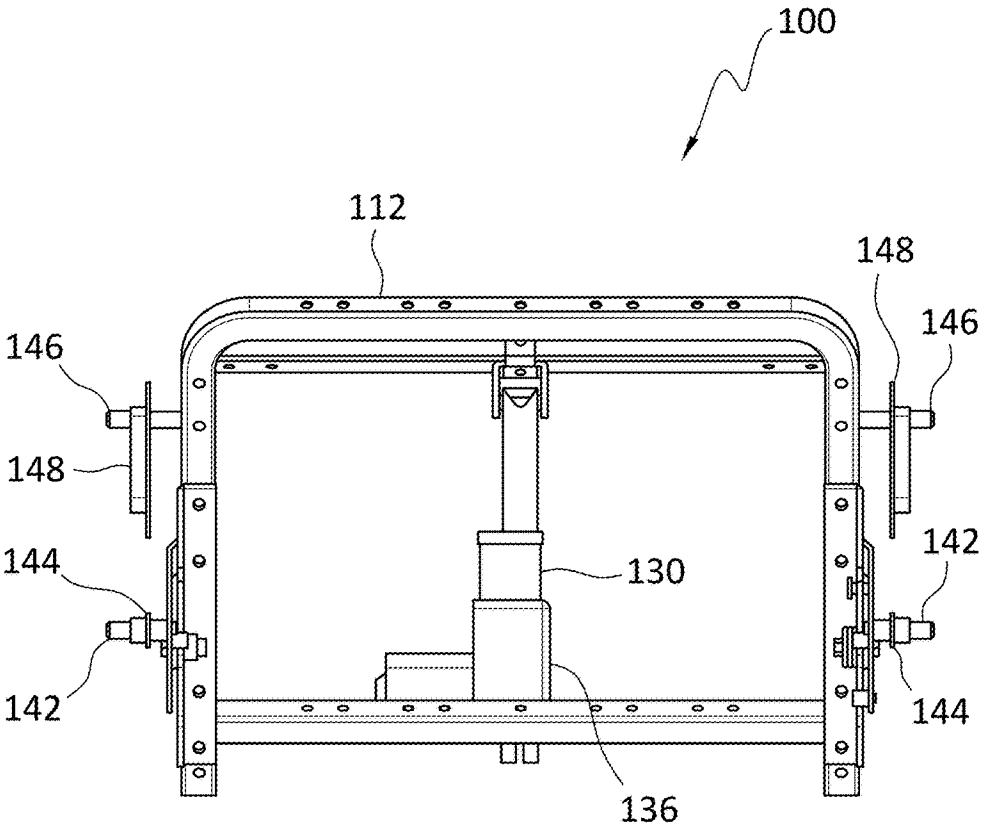
Figure 7:
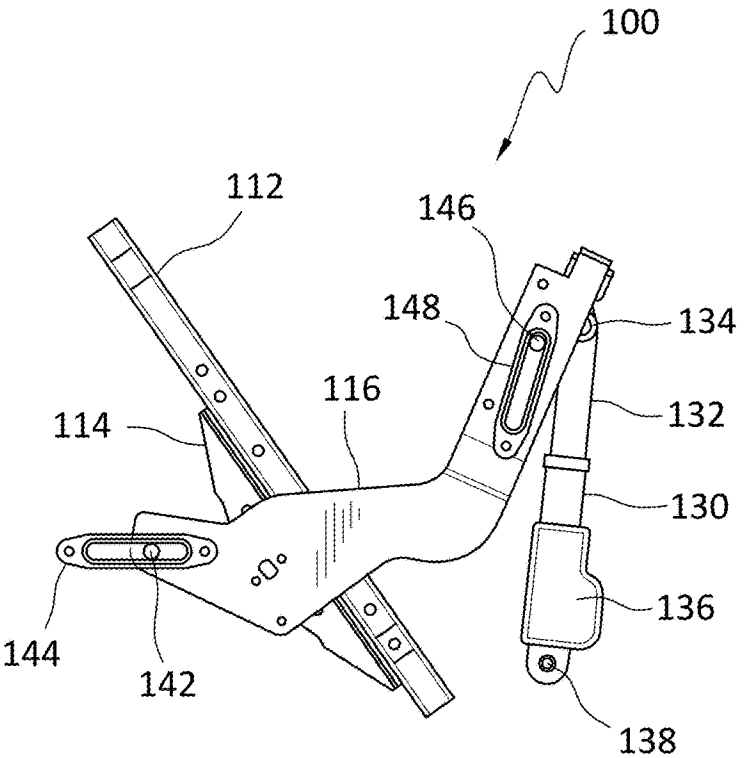
Figure 10:
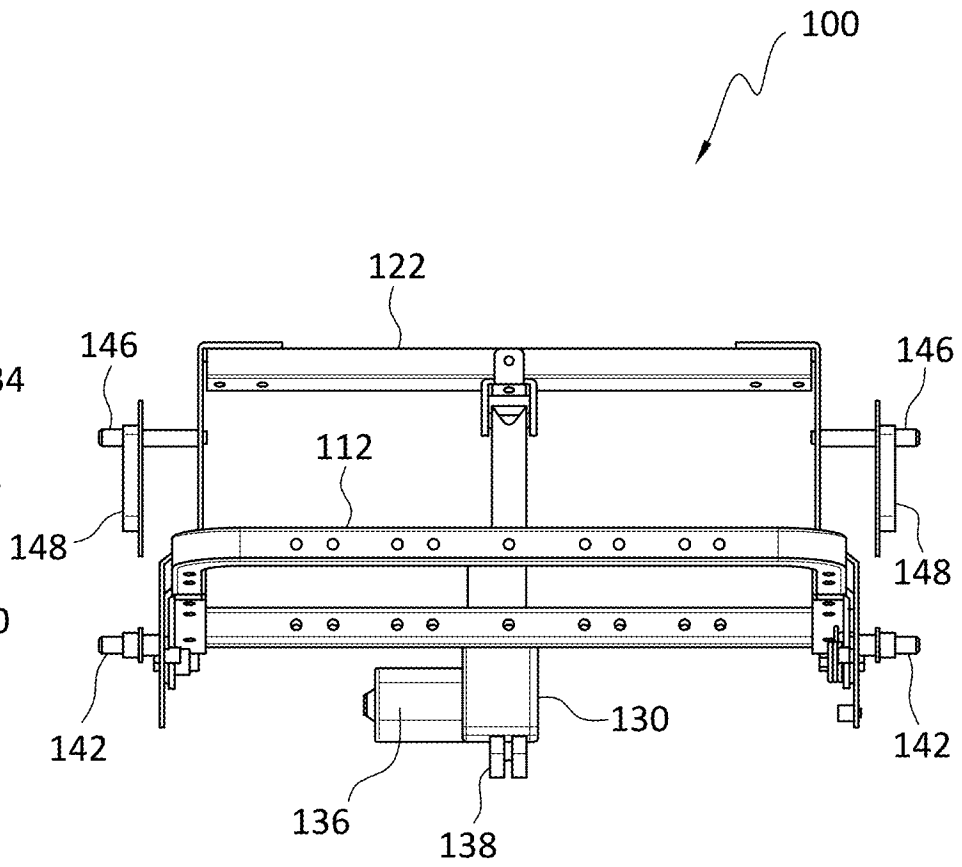
Figure 9:
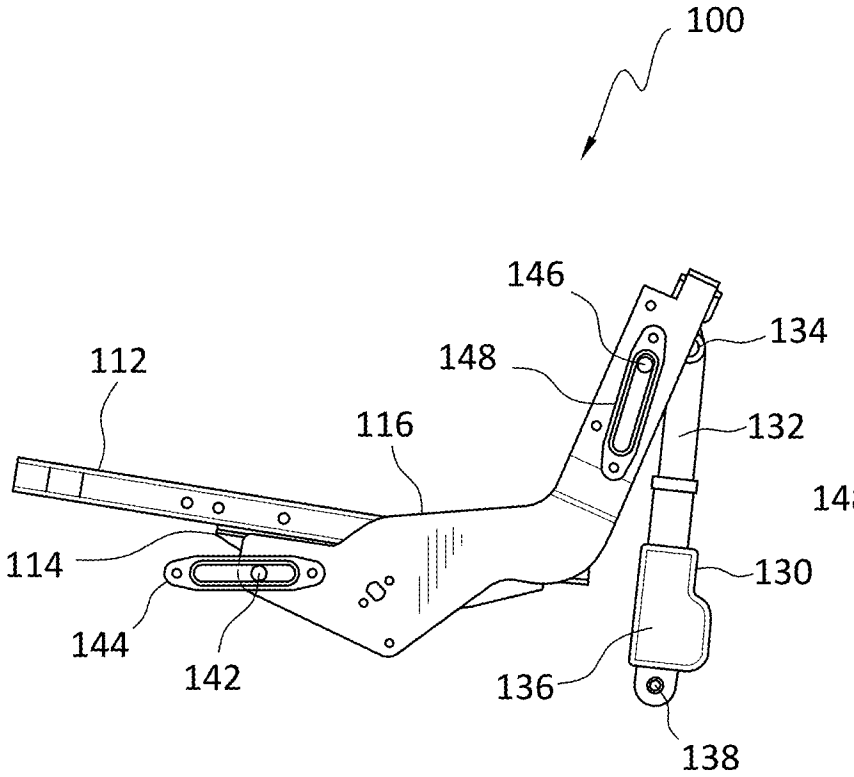
Figure 12:
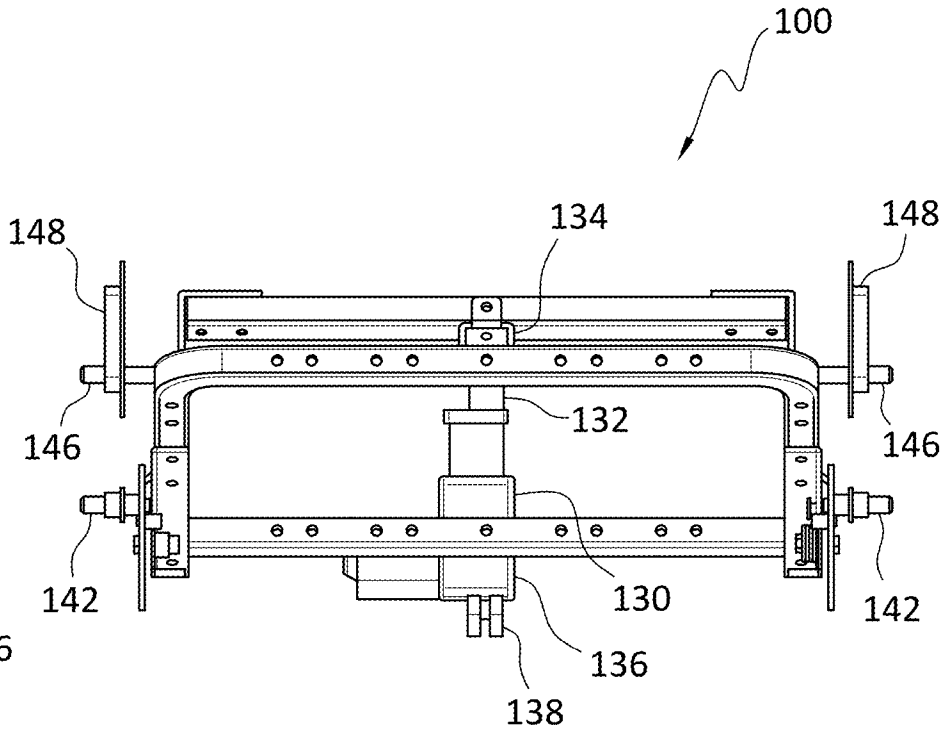
Figure 11:
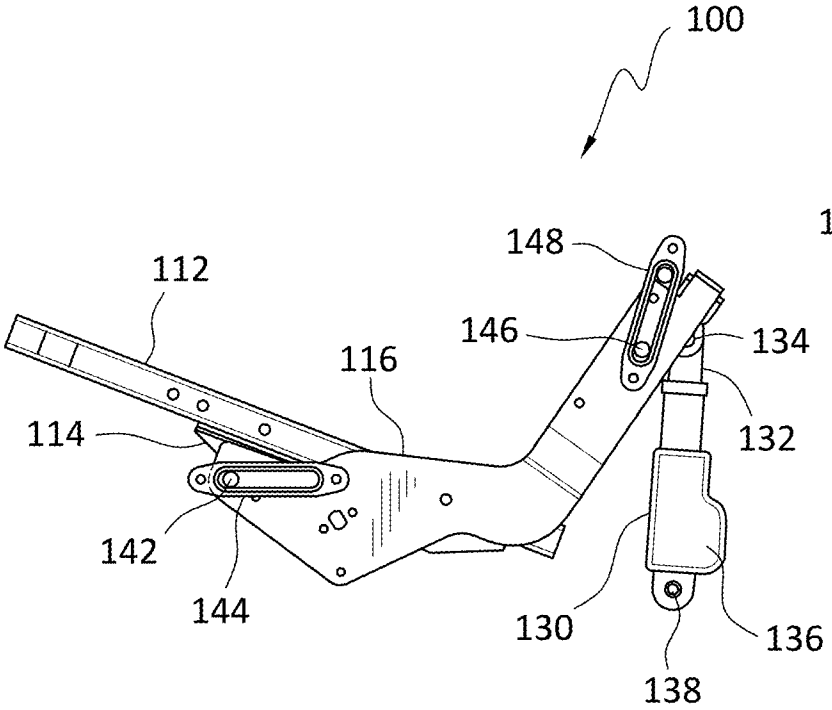
Figure 13:
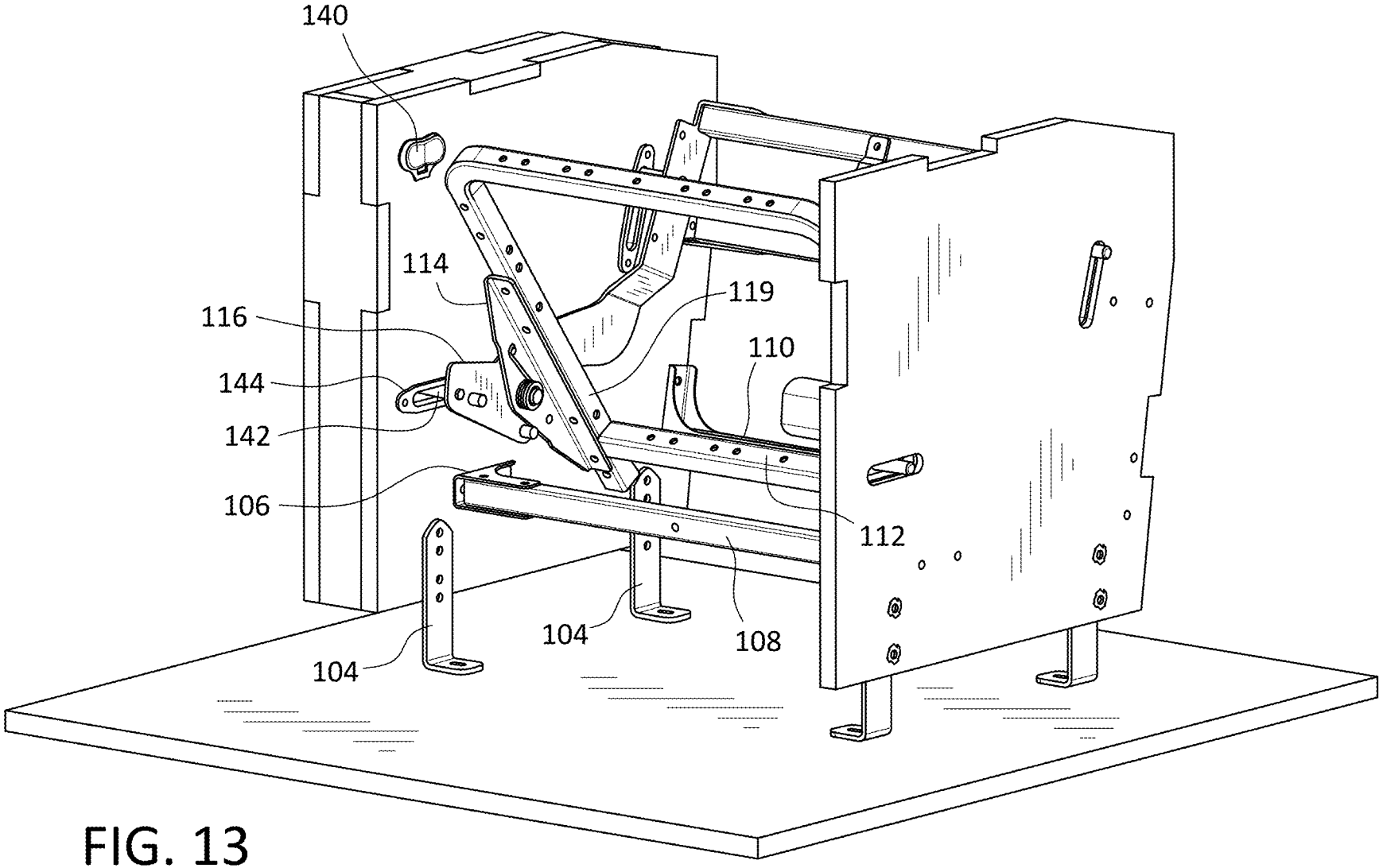
Figure 14:
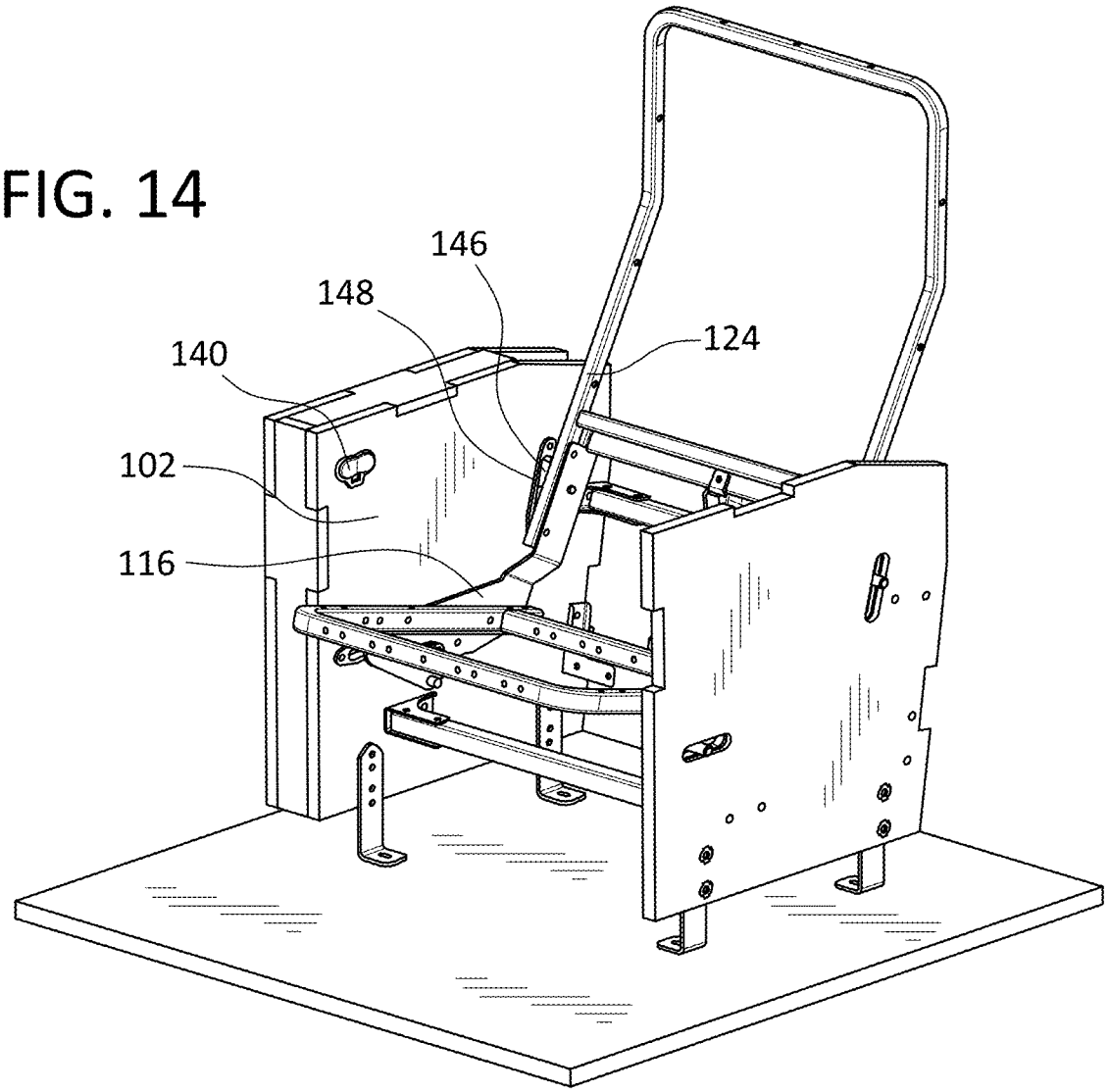

FIG. 5 is a side elevational view of the new and improved theater chair, as disclosed within FIG. 1, showing, however, the chair when the seat is disposed at its flip-down position, while the backrest assembly has been moved to its reclined position at which time the seat has also been moved to its reclined position at which the front portion of the seat is disposed at an elevation which is significantly higher than the elevation of the rear portion of the seat;

FIG. 6 is a front elevational view of the new and improved theater chair as disclosed within FIG. 5, showing the seat and backrest framework, but with the oppositely disposed sides of the chair frame being omitted for clarity;

FIG. 7 is an enlarged, detailed, side elevational view of one of the actuator mechanisms or assemblies of the new and improved theater chair of the present invention whereby the seat and backrest members of the theater chair can be moved between their non-reclined and reclined positions, FIG. 7 illustrating, more particularly, the relative dispositions of the actuator mechanism or assembly components when the seat member is disposed at its default flip-up position, and the backrest is disposed at its upright non-reclined position;

FIG. 8 is a front elevational view of the new and improved theater chair as disclosed within FIG. 7 when the actuator mechanisms or assemblies are disposed in their respective positions as illustrated within FIG. 7, and wherein the seat and backrest framework is disclosed, but with the oppositely disposed sides of the chair frame being omitted for clarity;

FIG. 9 is an enlarged, detailed, side elevational view of one of the actuator mechanisms or assemblies of the new and improved theater chair of the present invention, and is similar to FIG. 7, except that the seat member is disposed at its flip-down position, while the backrest is still disposed at its upright non-reclined position;

FIG. 10 is a front elevational view of the new and improved theater chair as disclosed within FIG. 9 when the actuator mechanisms or assemblies are disposed in their respective positions as illustrated within FIG. 9, and wherein the seat and backrest framework is disclosed, but with the oppositely disposed sides of the chair frame being omitted for clarity;

FIG. 11 is an enlarged, detailed, side elevational view of one of the actuator mechanisms or assemblies of the new and improved theater chair of the present invention, and is similar to FIGS. 7 and 9, except that the seat member is disposed at its flip-down position, the backrest is disposed at its reclined position, and the seat member is disposed at its reclined position at which the front portion of the seat is disposed at an elevation which is significantly higher than the elevation of the rear portion of the seat;

FIG. 12 is a front elevational view of the new and improved theater chair as disclosed within FIG. 11 when the actuator mechanisms or assemblies are disposed in their respective positions as illustrated within FIG. 11, and wherein the seat and backrest framework is disclosed, but with the oppositely disposed sides of the chair frame being omitted for clarity;

FIG. 13 is an enlarged, detailed, perspective view of the front region of the new and improved theater chair illustrating the pivotal mounting of the chair seat and backrest assembly upon the framework of the theater chair as permitted by means of the front pair of oppositely disposed rods movably disposed within the front pair of oppositely disposed, substantially horizontally oriented slots provided within the front regions of the theater chair; and FIG. 14 is an enlarged, detailed, perspective view the rear region of the new and improved theater chair illustrating the pivotal mounting of the chair seat and backrest assembly upon the framework of the theater chair as permitted by means of the rear pair of oppositely disposed rods movably disposed within the rear pair of oppositely disposed, substantially inclined slots provided within the rear regions of the theater chair.

DETAILED DESCRIPTION OF THE PREFERRED EMBODIMENT

Referring now to the drawings, and more particularly to FIGS. 1-14 thereof, it is seen that the new and improved theater chair, as developed in accordance with the principles and teachings of the present invention, is disclosed and is generally indicated by the reference character 100. More particularly, it is seen that the new and improved theater chair 100 is seen to comprise a chair framework which essentially comprises a pair of oppositely disposed chair side arms 102, a plurality of upstanding front and rear legs 104 disposed at the four corners of the chair framework, a pair of oppositely disposed side frame members 106, only one of which is shown, respectively bolted or otherwise fixedly connected to the pair of oppositely disposed chair side arms 102, it being noted that the plurality of upstanding front and rear legs 104 are likewise respectively bolted or otherwise fixedly connected to the pair of oppositely disposed side frame members 106, and front and rear, lower transverse cross beams or support tubes 108, 110, bolted or otherwise fixedly connected to the upstanding front and rear legs 104. In addition to the chair framework, it is seen that the chair 100 also comprises a seat framework 112, upon which a chair seat member, not shown, may be fixedly secured, and a pair of oppositely disposed seat framework mounting brackets 114, only one of which is shown, wherein each one of the seat framework mounting brackets 114 is pivotally mounted upon a front end portion of a respective one of a pair of oppositely disposed seat carrier chassis plates 116 by means of suitable pivot mechanisms 118. The seat framework 112 has a substantially square-shaped configuration, and the seat framework mounting brackets 114 are provided with upper angle-iron portions 119 to which side sections or members of the seat framework 112 can be bolted or otherwise fixedly connected. In conjunction with these components, a torsional spring 120, or the like, is operatively associated with the pivot mechanisms 118 so as to normally pivotally bias the seat framework 112, upon which the chair seat member, not shown, is fixedly secured, to a normal, default, flip-up position, such as, for example, when the occupant of the chair seat vacates the seat. In lieu of the torsional spring 120, other appropriate mechanisms may be utilized, such as, for example, weights, gas cylinders, or extension springs.

Continuing further, it is additionally seen that a backrest framework 122, to which a backrest member, not shown, may be fixedly secured, has a substantially U-shaped configuration with oppositely disposed side leg portions 124, 126 thereof being fixedly secured at the lower end portions thereof to rear end portions of the pair of oppositely disposed carrier chassis plates 116. In addition, it is also seen that the backrest framework 122 is provided with a transversely extending cross-beam or support tube 128, and a linear actuator 130 is operatively connected to the backrest framework 122 so as to move the same, along with the seat framework 112 to which the backrest framework 122 is integrally connected by means of the pair of oppositely disposed carrier chassis plates 116 and the seat framework mounting brackets 114. More particularly, it is seen that the free or distal end of the extendable/retractable telescopic rod 132 of the linear actuator 130 is pivotally connected to a central portion of the transversely extending cross-beam or support tube 128 by means of a first clevis-type or similar connector 134, while the motor end 136 of the linear actuator 130 is pivotally connected to the rear, lower transversely extending cross beam or support tube 110 by means of a second clevis-type or similar connector 138. As can be seen in FIGS. 13 and 14, a manually-operated remote-control device 140, which is electrically/electronically connected to the linear actuator 130, is provided such that an occupant of the theater chair or seat 100 can actuate the linear actuator 130 whereby the entire backrest framework 122 and the seat framework 112 can be moved between their upright and reclined positions. In lieu of the linear actuator 130, a gas cylinder or a suitable spring mechanism may be employed.

With reference continuing to be made to FIGS. 13 and 14, it can best be seen, that in order to achieve the aforenoted movements of the backrest framework 122 and the seat framework 112 between the aforenoted upright and inclined positions, when the linear actuator 130 is activated so as to achieve the particular one of the upright and inclined positions, a first pair of oppositely disposed, transversely extending guide rods or pins 142 are fixedly mounted upon or within forward end portions of the pair of oppositely disposed carrier chassis plates 116, and a pair of slotted housings 144 are respectively provided within the oppositely disposed chair side arms 102, wherein it is seen that the pair of slotted housings 144 are disposed within the pair of oppositely disposed chair side arms 102 so as to have a substantially horizontal orientation, all as best seen in FIG. 13. In a similar manner, a second pair of oppositely disposed, transversely extending guide rods or pins 146 are fixedly mounted upon lower end portions of the pair of oppositely disposed side leg portions 124, 126 of the backrest framework 122, and a pair of slotted housings 148 are respectively provided within the oppositely disposed chair side arms 102, wherein it is seen that the pair of slotted housings 148 are disposed within the pair of oppositely disposed chair side arms 102 so as to have a substantially inclined orientation, all as best seen in FIG. 14. In this manner, when the telescopic rod or tube 132 of the linear actuator 130 is extended, the first set of pins or rods 142 will move rearwardly within the slotted housings 144, while the second set of pins or rods 146 will move upwardly within the slotted housings 148, such that the chair will attain its upright position wherein the backrest framework will be disposed at its upright position while the seat framework 112 will be disposed at a substantially horizontal orientation. To the contrary, when the telescopic rod or tube 132 of the linear actuator 130 is retracted, the first set of pins or rods 142 will move forwardly within the slotted housings 144, while the second set of pins or rods 146 will move downwardly within the slotted housings 148, such that the chair will attain its reclined position wherein the backrest framework 122 will be disposed at its reclined position while the seat framework 112 will likewise be disposed at its reclined position as can be appreciated from FIG. 6. It will be further appreciated that whenever the backrest framework 122 and the seat framework 112 are moved in conjunction with each other, as a result of the two frameworks being integrally connected together, the two frameworks will effectively undergo an arcuate movement, or in other words, follow a locus which has an arcuate configuration, moving, swinging, or pivotally moving from an upright, rearward position to a reclined, forward position. It is to be noted that the disposition or location of the pins or rods 142, 146, and the slotted housings 144, 148 may effectively be reversed, that is, the pins or rods 142, 146 projecting outwardly from interior portions of the chair side arms 102, while the slotted housings 144, 148 are defined within the opposite legs of the backrest framework 122. Still further, in lieu of utilizing pins or rods 142, 146 and the slotted housings 144, 148, suitable wheels and tracks may serve as the structure facilitating the movements of the backrest framework 122 and the seat framework 112.

In accordance with a last feature of the present invention, while it has been noted that the linear actuator 130, and the chair 100, can be remotely controlled manually by means of the remote-control device 140, a unique feature of the present invention is to enable the chair 100 to be automatically returned from its reclined position to its upright position as a result of the occupant of the chair 100 vacating the chair 100. More particularly, when the occupant of the chair 100 vacates the chair 100, the seat framework 112, having a seat cushion or the like, not shown, fixedly attached thereto, will automatically be moved to the flip-up position as shown in FIG. 1 under the spring bias of torsional spring 120. A suitable proximity sensor 150, schematically illustrated within FIG. 1 and mounted upon at least one of the pair of oppositely disposed carrier chassis plates 116, will detect the movement of the seat framework 112, and the seat cushion or the like, not shown, fixedly mounted thereon, from the flip-down position to the flip-up position. The proximity sensor can be any one of a variety of proximity sensors, such as, for example, a capacitive type proximity sensor, an inductive type proximity sensor, a magnetic type proximity sensor, an optical type proximity sensor, or an ultrasonic type proximity sensor. Regardless of which type of proximity sensor is used, the proximity sensor 150 will detect the movement of the seat framework 112, and the seat cushion, not shown, fixedly mounted thereon, from the flip-down position to the flip-up position, and will generate an electrical signal which is transmitted to a timer control circuit, schematically illustrated at 152, whereby the timer control circuit, after a predetermined time period or lapse, will, in turn, generate an electrical signal which is transmitted to the linear actuator 130. Accordingly, the linear actuator 130 will be activated so as to return the backrest framework 122, and the seat framework 112, from their reclined positions to their upright positions. It is to be lastly noted that in lieu of the use of the timer-control circuit 152, a control circuit may be utilized whereupon as soon as the sensor 150 detects the vacancy of the chair seat, the backrest framework 122 and the seat framework 112, are immediately returned to their upright positions without any time lapse as dictated by the timer of the timer-control circuit 152.

Obviously, many variations and modifications of the present invention are possible in light of the above teachings. It is therefore to be understood that within the scope of the appended claims, the present invention may be practiced otherwise than as specifically described herein.

What is claimed, and desired to be protected by Letters Patent, is:

1. A chair, comprising:

a chair framework;

a backrest framework;

a pair of oppositely disposed seat carrier chassis plates integrally connected to said backrest framework and having a seat framework pivotally mounted upon said pair of oppositely disposed seat carrier chassis plates such that said seat framework is movable between a first seat-up position and a second seat-down position, and wherein said pair of oppositely disposed seat carrier chassis plates are movably mounted upon said chair framework so as to be movable between a first rear position, at which said backrest framework is disposed at a rear, upright position, and said seat framework, when disposed at said second seat-down position, is likewise disposed at a rear upright position at which said seat framework is disposed within a substantially horizontally plane, and a second forward position at which both said backrest framework and said seat framework are disposed at forward reclined positions;

a first forward pair of oppositely disposed slotted housings defined within one of a forward portion of said chair framework or forward portions of said pair of oppositely disposed seat carrier chassis plates;

a first forward pair of oppositely disposed pins/rods integrally connected to one of forward portions of said pair of oppositely disposed seat carrier chassis plates or said forward portion of said chair framework;

a second rearward pair of oppositely disposed slotted housings defined within one of a rearward portion of said chair framework or said pair of oppositely disposed portions of said backrest framework;

a second rearward pair of oppositely disposed pins/rods are integrally connected to one of said pair of oppositely disposed portions of said backrest framework or a rearward portion of said chair framework; and an actuator operatively connected to said chair framework and to said backrest framework for moving said backrest framework, said pair of oppositely disposed seat carrier chassis plates, and said seat framework between said first rear upright position and said second forward reclined position.

2. The chair as set forth in claim 1, wherein:

said first forward pair of oppositely disposed slotted housings, defined within one of said forward portion of said chair framework or forward portions of said pair of oppositely disposed seat carrier chassis plates, have a substantially horizontal orientation; and said second rearward pair of oppositely disposed slotted housings, defined within one of said rearward portion of said chair framework or said pair of oppositely disposed portions of said backrest framework, have an inclined orientation, whereby, when said actuator, operatively connected to said chair framework and to said backrest framework, is actuated, said actuator moves said backrest framework, said at least one seat carrier chassis plate, and said seat framework between said first rear upright position and said second forward reclined position.

3. The chair as set forth in claim 2, wherein:

when said actuator, operatively connected to said chair framework and to said backrest framework, is actuated so as to move said backrest framework, said pair of oppositely disposed seat carrier chassis plates, and said seat framework between said first rear upright position and said second forward reclined position, said backrest framework and said seat framework will undergo movement which follows an arcuate locus.

4. The chair as set forth in claim 1, wherein:

said actuator comprises a linear actuator.

5. The chair as set forth in claim 1, wherein:

said actuator is selected from the group comprising a linear actuator, a gas cylinder, and a spring mechanism.

6. A chair, comprising:

a chair framework;

a backrest framework;

a pair of oppositely disposed seat carrier chassis plates integrally connected to said backrest framework and having a seat framework pivotally mounted upon said pair of oppositely disposed seat carrier chassis plates such that said seat framework is movable between a first seat-up position and a second seat-down position, and wherein said pair of oppositely disposed seat carrier chassis plates are movably mounted upon said chair framework so as to be movable between a first rear position, at which said backrest framework is disposed at a rear, upright position, and said seat framework, when disposed at said second seat-down position, is likewise disposed at a rear upright position at which said seat framework is disposed within a substantially horizontally plane, and a second forward position at which both said backrest framework and said seat framework are disposed at forward reclined positions;

an actuator operatively connected to said chair framework and to said backrest framework for moving said backrest framework, said pair of oppositely disposed seat carrier chassis plates, and said seat framework between said first rear upright position and said second forward reclined position;

said seat framework is normally biased toward said first seat-up position such that first seat-up position comprises a default position; and a proximity sensor operatively associated with said seat framework for sensing the disposition of said seat framework and said movement of said seat framework between said first seat-up position and said second seat-down position.

7. The chair as set forth in claim 6, wherein:

a biasing mechanism is operatively connected between said seat framework and each one of said pair of oppositely disposed seat carrier chassis plates such that said seat framework is biased toward said first seat-up position when said chair is vacated.

8. The chair as set forth in claim 7, wherein:

said biasing mechanism comprises a torsional spring.

9. The chair as set forth in claim 7, wherein:

said biasing mechanism is selected from the group comprising a torsional spring, weights, gas cylinders, and extension springs.

10. The chair as set forth in claim 7, wherein:

said proximity sensor is selected from the group of proximity sensors comprising a capacitive type proximity sensor, an inductive type proximity sensor, a magnetic type proximity sensor, an optical type proximity sensor, or an ultrasonic type proximity sensor.

11. The chair as set forth in claim 6, wherein:

said proximity sensor detects movement of said seat framework from said second seat-down position to said first seat-up position so as to detect when said chair has been vacated.

12. The chair as set forth in claim 11, wherein:

said proximity sensor generates an electrical/electronic signal when said proximity sensor detects movement of said seat framework from said second seat-down position to said first seat-up position, thereby indicating that said chair has been vacated.

13. The chair as set forth in claim 12, further comprising: a timer-control circuit operatively connected to said proximity sensor and to said actuator for receiving said electrical/electronic signal, generated by said proximity sensor, and for generating an electrical/electronic signal, after a predetermined time period, for transmission to said actuator for actuating said actuator whereby said actuator will automatically move said backrest framework, said pair of oppositely disposed seat carrier chassis plates, and said seat framework from said second forward reclined position to said first rear upright position when said chair has been vacated.

14. The chair as set forth in claim 12, further comprising: a control circuit operatively connected to said proximity sensor and to said actuator for receiving said electrical/electronic signal, generated by said proximity sensor, and for generating an electrical/electronic signal for transmission to said actuator for actuating said actuator whereby said actuator will automatically move said backrest framework, said pair of oppositely disposed seat carrier chassis plates, and said seat framework from said second forward reclined position to said first rear upright position when said chair has been vacated.

* * * * *